US007328463B2

(12) United States Patent
Jones et al.

(10) Patent No.: US 7,328,463 B2
(45) **Date of Patent: *Feb. 12, 2008**

(54) WATER-SOLUBLE ARTICLES AND METHODS OF MAKING AND USING THE SAME

(75) Inventors: Joan Adell Jones, Lawrenceville, GA (US); John B. Steward, McKinney, TX (US)

(73) Assignee: Microtek Medical Holdings, Inc.

( * ) Notice: Subject to any disclaimer, the term of this patent is extended or adjusted under 35 U.S.C. 154(b) by 495 days.

This patent is subject to a terminal disclaimer.

(21) Appl. No.: 10/657,359

(22) Filed: Sep. 8, 2003

(65) Prior Publication Data

US 2005/0050608 A1 Mar. 10, 2005

(51) Int. Cl.
*A41D 13/00* (2006.01)
*A62B 17/00* (2006.01)

(52) U.S. Cl. ..... 2/456; 2/457; 2/69; 2/81; 2/227; 2/247

(58) Field of Classification Search ..... 2/456, 2/457, 458, 69, 46, 81, 227, 247
See application file for complete search history.

(56) References Cited

U.S. PATENT DOCUMENTS

| | | | | |
|---|---|---|---|---|
| 3,950,789 | A | 4/1976 | Konz et al. | |
| 4,033,354 | A | 7/1977 | De Rosa | |
| D292,140 | S | 10/1987 | Cahill et al. | |
| 4,738,119 | A | 4/1988 | Zafred | |
| D305,700 | S | 1/1990 | Werner | |
| 4,902,558 | A * | 2/1990 | Henriksen | 428/220 |
| 5,059,477 | A * | 10/1991 | Henriksen | 428/220 |
| 5,181,967 | A | 1/1993 | Honeycutt | |
| 5,207,837 | A * | 5/1993 | Honeycutt | 134/42 |
| 5,487,189 | A * | 1/1996 | Bell | 2/79 |
| 5,509,142 | A * | 4/1996 | Connell et al. | 2/79 |
| 5,511,246 | A * | 4/1996 | Farkas et al. | 2/79 |
| 5,650,219 | A * | 7/1997 | Honeycutt | 442/400 |
| D384,788 | S | 10/1997 | Curry | |
| 5,762,716 | A * | 6/1998 | Lockard et al. | 134/2 |
| 5,770,529 | A * | 6/1998 | Dennis et al. | 442/268 |
| 5,780,098 | A * | 7/1998 | Battles | 427/2.1 |
| 5,869,193 | A * | 2/1999 | Langley | 428/520 |
| 5,871,679 | A * | 2/1999 | Honeycutt | 264/185 |
| 5,931,971 | A * | 8/1999 | Zucker | 8/137 |
| RE36,399 | E | 11/1999 | Honeycutt | |
| 6,002,064 | A * | 12/1999 | Kobylivker et al. | 604/367 |
| 6,029,274 | A * | 2/2000 | Welchel et al. | 2/69 |
| 6,047,413 | A * | 4/2000 | Welchel et al. | 2/457 |
| 6,048,410 | A * | 4/2000 | Honeycutt | 134/42 |
| 6,076,662 | A * | 6/2000 | Bahten | 206/207 |

(Continued)

FOREIGN PATENT DOCUMENTS

DE 4132804 10/1992

OTHER PUBLICATIONS

Japanese Abstract, Hirosuke, "Nonwoven Fabric Soluble in Hot Water", Nippon Synthetic Chem. In. Co. Ltd., No. 9, Apr. 27, 1999.

*Primary Examiner*—Robert H Muromoto, Jr.
(74) *Attorney, Agent, or Firm*—Withers & Keys, LLC

(57) ABSTRACT

Water-soluble articles and methods of making, using and disposing of the water-soluble articles are disclosed.

32 Claims, 4 Drawing Sheets

U.S. PATENT DOCUMENTS 6,112,385 A * 9/2000 Fleissner et al. ..... 28/104
6,139,675 A * 10/2000 Druecke et al. ..... 156/277
6,192,521 B1 * 2/2001 Alberts et al. ..... 2/227
H001969 H * 6/2001 Fell et al. ..... 604/367
6,277,479 B1 * 8/2001 Campbell et al. ..... 428/213
H002011 H * 1/2002 Freiburger et al. ..... 604/381
D453,055 S 1/2002 Ode
6,341,384 B1 * 1/2002 Hayes ..... 2/458
D456,115 S 4/2002 Johnston
6,473,910 B2 * 11/2002 Creagan et al. ..... 2/458
6,485,528 B1 * 11/2002 Bartels et al. ..... 8/405
6,495,612 B1 * 12/2002 Corzani et al. ..... 523/105
6,500,200 B1 * 12/2002 Kushnir ..... 607/104
6,638,636 B2 * 10/2003 Tucker ..... 428/515
6,699,952 B2 * 3/2004 Chaikof et al. ..... 526/277
6,726,536 B1 * 4/2004 Drake et al. ..... 451/39
6,854,135 B2 * 2/2005 Jones et al. ..... 2/456

* cited by examiner

WATER-SOLUBLE ARTICLES AND METHODS OF MAKING AND USING THE SAME

FIELD OF THE INVENTION

The present invention relates to water-soluble articles for use in industry. The present invention further relates to methods of making and using water-soluble articles.

BACKGROUND OF THE INVENTION

During the twentieth century, international treaties, congressional acts, and executive orders have resulted in a number of regulations controlling all aspects of the environment and health and safety practices in the workplace. In particular, the disposal of industrial waste has been heavily regulated. Landfills nationwide have been closed and industry has been forced to turn to using alternatives such as conservation, recycling and incineration. A representative example is the medical industry, which generates millions of pounds of waste each year. Much of the generated waste is related to the use of disposable materials, such as personal protective clothing, equipment, and accessories necessary for patient care. These disposable materials become contaminated with bloodborne pathogens and are therefore unsafe for reuse. To prevent the spread of disease, these materials are typically discarded after a single use.

In addition, the nuclear industry also generates millions of pounds of waste each year. In the nuclear industry, much of the waste is similarly related to the use of disposable materials such as personal protective clothing, bags, mop heads, wipes, and other accessories that become contaminated by radioactive material, and become unsafe or impractical for reuse. The waste disposal and landfilling practices of the nuclear industry are highly regulated, and nuclear burial ground space is limited.

Various other industries also generate waste streams with similar characteristics. Efforts continue to efficiently and effectively handle waste and other contaminants in various industries.

There exists a need in the art of effective methods and products for handling and minimizing waste and contaminants from industries, such as the medical and nuclear industries.

SUMMARY OF THE INVENTION

The present invention addresses some of the difficulties and problems discussed above by the discovery of new water-soluble products. In one exemplary embodiment, the water-soluble product comprises a water-soluble vest. The water-soluble vest may be a single-use vest or a limited reusable vest. Although the limited reusable vests contain water-soluble material, the limited reusable vests maintain structural integrity during multiple washing cycles so that the vest may be reused between washing cycles. Further, the limited reusable vests are virtually contaminant-free after washing due to their ability to release contaminants during the washing process. The single-use and limited reusable vests may be used in an unlimited number of industries and applications, and find particular usefulness in the medical and nuclear industries.

Other water-soluble products of the present invention include, but are not limited to, water-soluble surgeon caps, utility aprons, labcoats, spill socks, splash-resistant coveralls, scrubs, modesty clothing, spill mats and pads, and glove liners. The other water-soluble products may be single-use products or limited reusable products as described below. Exemplary water-soluble, limited reusable products of the present invention include, but are not limited to, labcoats, splash-resistant coveralls, scrubs, and modesty clothing.

The present invention is further directed to methods of making and using the water-soluble products. In one exemplary method, the water-soluble products are used for a particular purpose, and then disposed of by solubilizing the water-soluble material of the single-use products. In a further exemplary method, the water-soluble products are used for a particular purpose, washed to substantially remove any contaminants on or in the product due to such use, and then reused for the same particular purpose or a different purpose. After experiencing a number of washing cycles, the limited reusable products are disposed of by solubilizing the water-soluble material of the limited reusable product.

The present invention is also directed to methods of removing one or more contaminants from a product containing water-soluble material, wherein the method comprises washing the product in an aqueous bath under washing condition such that the water-soluble material does not become soluble. The method may comprise a number of additional steps including drying the washed product. In one exemplary embodiment of the present invention, the method is used to remove one or more contaminants from a product, such as an ice vest used in the nuclear industry.

The present invention is even further directed to methods of reducing an amount of radioactive waste generated by at least one contaminated product, wherein the method comprises (a) washing the at least one contaminated product in an aqueous bath under washing condition such that the at least one product does not become soluble; and (b) washing the at least one contaminated product in an aqueous bath under washing condition such that at least a portion of the product becomes soluble. The exemplary method may comprise a number of additional steps including drying the washed product after washing step (a), and reusing the washed product. In one exemplary embodiment of the present invention, the method is used to reduce the amount of radioactive waste generated by a contaminated product, such as an ice vest.

These and other features and advantages of the present invention will become apparent after a review of the following detailed description of the disclosed embodiments and the appended claims.

DETAILED DESCRIPTION OF THE INVENTION

Figure 1A:
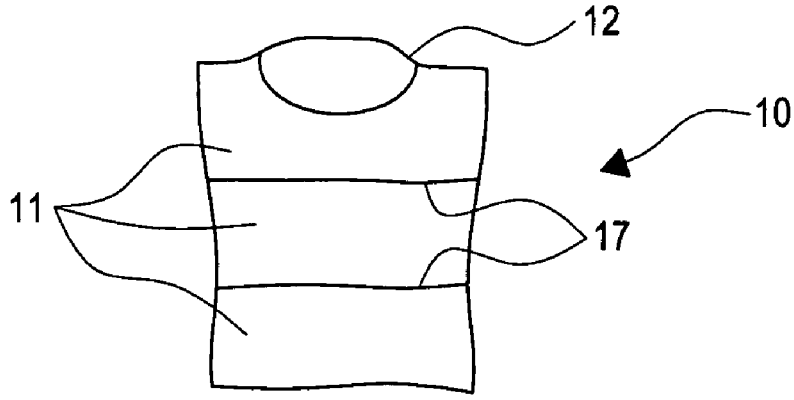
FIG. 1A depicts a frontal view of an exemplary vest of the present invention.

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

I. Water-Soluble Products

The present invention is directed to water-soluble products and methods of using the water-soluble products. A description of exemplary water-soluble products is given below.

A. Vests Containing Water-Soluble Material

The present invention is directed to vests containing water-soluble or water-dispersible material. The vest may be a single-use vest or a limited reusable vest. Suitable vests include, but are not limited to, dosimetry vests and ice vests. In one exemplary embodiment of the present invention, the vest is a single-use product comprising one or more pieces of water-soluble material. In a further exemplary embodiment of the present invention, the vest is a launderable product comprising one or more pieces of water-soluble material.

1. Vest Components

The vests of the present invention comprise one or more of the following components.

a. Water-Soluble Material

The vests of the present invention comprise water-soluble material with or without water-insoluble material. As used herein, the term "water-soluble" refers to materials having a degree of solubility in water at a water temperature of 37° C. or above. When the vest contains both water-soluble and water-insoluble material, the combined materials are configured so that at least a portion of the overall product is "water-dispersible." As used herein, the term "water-dispersible" refers to a composite material, which typically contains water-soluble material in combination with water-insoluble material, and is capable of forming a dispersion in an aqueous bath at or above ambient temperature (about 20° C.) and, in some cases, in an aqueous bath at or above ambient temperature (about 20° C.) and having a pH of above 7.0.

Suitable water-soluble materials for use in the present invention include, but are not limited to, polyvinyl alcohol; polyacrylic acid; polymethacrylic acid; polyacrylamide; water-soluble cellulose derivatives such as methyl celluloses, ethyl celluloses, hydroxymethyl celluloses, hydroxypropyl methyl celluloses, and carboxymethyl celluloses; carboxymethylchitin; polyvinyl pyrrolidone; ester gum; water-soluble derivatives of starch such as hydroxypropyl starch and carboxymethyl starch; and water-soluble polyethylene oxides. Suitable alkali water-soluble materials for use in the present invention include, but are not limited to, ethylene copolymers of acrylic acid (EAA) and methacrylic acid (EMAA), and salts thereof; and ionomers containing acrylic acid and/or methacrylic acid. Desirably, the water-soluble material comprises polyvinyl alcohol with or without acetyl groups, cross-linked or uncross-linked. Suitable polyvinyl alcohol materials are described in U.S. Pat. Nos. 5,181,967; 5,207,837; 5,268,222; 5,620,786; 5,885,907; and 5,891,812; and U.S. patent application Ser. No. 09/280,791 filed on Mar. 26, 1999 and entitled "SPUNLACED POLY(VINYL ALCOHOL) FABRICS"; the disclosures of all of which are hereby incorporated in their entirety by reference.

Suitable water-insoluble materials for use in the present invention include, but are not limited to, polyurethane resin, ion exchange resins, sodium polyacrylate, polymaleic acid, ammonium polyacrylate, microbial polyesters, polyhydroxybutyrate, polyhydroxybutyrate-valerate, polyhydroxyalkanoates, polyesters, polyglycolic acid, polyhydroxy acids, aliphatic polyesters, aromatic polyesters, aliphatic-aromatic copolyesters, aliphatic polyetheresters, aromatic polyetheresters, aliphatic-aromatic copolyetheresters, aliphatic polyesteramides, aromatic polyesteramides, aliphatic-aromatic copolyesteramides, aliphatic polyetherester amides, aromatic polyetherester amides, aliphatic-aromatic copolyetherester amides, polyethylene terephthalate, cellulose acetates, polycaprolactone, starch, starch blends, or mixtures thereof, polystyrene, nylon, polyester, polyolefin, polypropylene, polycarbonate, acrylonitrile butadiene styrene, polyethylene, ethylene vinyl acetate copolymer, ethylene methacrylate copolymer, ethylene olefin copolymer, cotton, rayon, cellulose or a mixture.

The vests of the present invention may contain any of the above-described water-soluble materials alone or in combination with any of the above-described water-insoluble materials. Desirably, the construction of the vest is such that each component of the vest (e.g., fabric components, sheet fastening devices, sheet closure systems, wash marker indicator, etc.) either (1) completely dissolves or (2) breaks up into small particles/pieces when exposed to conditions, which cause the water-soluble component(s) of the vest to become soluble.

In some embodiments of the present invention, the vest comprises water-soluble material alone or in combination with water-insoluble material. When water-insoluble materials are used to form a vest of the present invention, desirably less than about 50 parts by weight (pbw) of water-insoluble material is used in combination with at least about 50 parts by weight (pbw) of water-soluble material to form the vest, based on the total parts by weight of the vest. More desirably, the vest comprises at least about 70 pbw of water-soluble material and less than about 30 pbw of water-insoluble material, even more desirably, at least about 90 pbw of water-soluble material and less than about 10 pbw of water-insoluble material, based on a total parts by weight of the vest.

In a further embodiment, the vest consists essentially of water-soluble material. In yet a further embodiment, the vest consists of water-soluble material.

In one embodiment, the vest comprises one or more sheets of nonwoven fabric. Desirably, the one or more sheets of nonwoven fabric comprise spunbonded or spunlaced polyvinyl alcohol fibers. Alternatively, the nonwoven fabric may be formed by one or more of the following processes: melt-blowing; dry carding and hydroentangling; thermally bonding; dry laying and carding followed by needle-punching; carding; chemical bonding; needle-punching; or any combination thereof. Desirably, the vests of the present invention comprise one or more sheets of spunlaced nonwoven fabric formed from polyvinyl alcohol fibers and having a basis weight of up to about 100 grams per square meter (gsm), more desirably, from about 50 to about 80 gsm, even more desirably, about 65 gsm.

In still a further embodiment, the vest comprises one or more sheets of woven fabric formed by weaving water-soluble fibers, such as polyvinyl alcohol fibers. In yet another embodiment, the vest comprises one or more sheets of knitted fabric formed by knitting water-soluble fibers, such as polyvinyl alcohol fibers. Any known technique for knitting and/or weaving fibers may be employed to form the vests of the present invention.

In further desired embodiments of the present invention, the vest comprises at least one fabric layer, at least one film layer, or a combination thereof, wherein each of the layers comprises, consists essentially of, or consists of polyvinyl alcohol (PVA). The polyvinyl alcohol may be in fibrous form or film form. Suitable PVA fibers and films and methods of making PVA fibers and films are disclosed in U.S. Pat. Nos. 5,181,967; 5,207,837; 5,268,222; 5,620,786; 5,885,907; and 5,891,812; and U.S. patent application Ser. No. 09/280,791 filed on Mar. 26, 1999 and entitled "SPUN-LACED POLY(VINYL ALCOHOL) FABRICS"; the disclosures of all of which are hereby incorporated in their entirety by reference. An example of a suitable polyvinyl alcohol fiber for use in the present invention is a polyvinyl alcohol homopolymer that has been highly crystallized by post-drawing or by heat annealing.

b. Sheet Fastening Devices

The vests of the present invention may comprise one or more sheet fastening devices to connect one or more fabric and/or film sheets to one another. Suitable sheet fastening devices include, but are not limited to, thread, adhesives, hoop and loop materials, or a combination thereof. Desirably, when two or more of the above-described sheets or films are used to form the vests of the present invention, the two or more sheets are attached to one another using thread. Suitable thread includes, but is not limited to, thread comprising any of the above-described water-soluble materials, thread comprising any of the above-described water-insoluble materials, or a combination thereof.

In one exemplary embodiment of the present invention, the thread used to connect two or more sheets together comprises polyethylene terephthalate (PET). In a further exemplary embodiment of the present invention, the thread used to connect two or more sheets together comprises polyvinyl alcohol (PVA) alone or in combination with one or additional components to form a water-dispersible thread.

c. Closure System

The vests of the present invention may also comprise one or more sheet closure systems to temporarily attach a front section of the vest to a rear section of a vest, or a front section of a vest to another front section of a vest (i.e., similar to buttons on a shirt). Suitable closure systems include, but are not limited to, one or more zippers, drawstrings, snaps, buttons, adhesives, hoop and loop materials, or a combination thereof.

In one exemplary embodiment of the present invention, the vests comprise a closure system comprising one or more hoop and loop materials. The one or more hoop and loop materials may comprise water-insoluble materials, water-soluble materials, or water-dispersible materials as described above. Desirably, the one or more hoop and loop materials comprise water-soluble materials alone or in combination with one or additional components to form water-dispersible materials.

d. Wash Marker Indicators

The vests of the present invention may further comprise a wash marker indicator to indicate how many wash cycles the vest has been exposed to. Suitable wash marker indicators include, but are not limited to, a detachable strip of vest material.

e. Pockets

The vests of the present invention may be pocketless or may comprise one or more pockets. Typically, the vests comprise up to about 15 pockets. One or more of the pockets may have a flap closure to close the pocket. In other embodiments, a hook and loop material as described above may be used to close the pocket.

2. Types of Vests

Figure 1B:
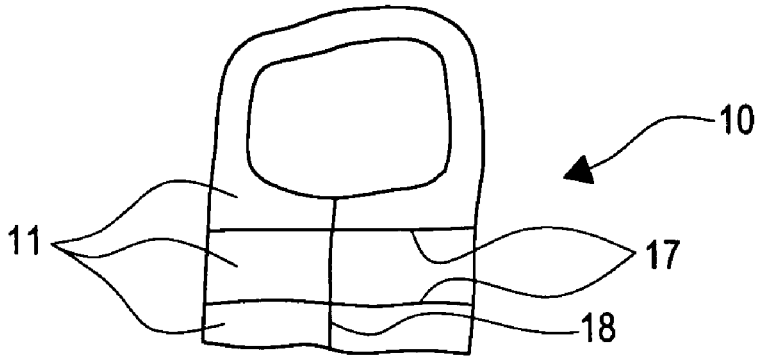
FIG. 1B depicts a side view of the exemplary vest of FIG. 1A.
Figure 1C:
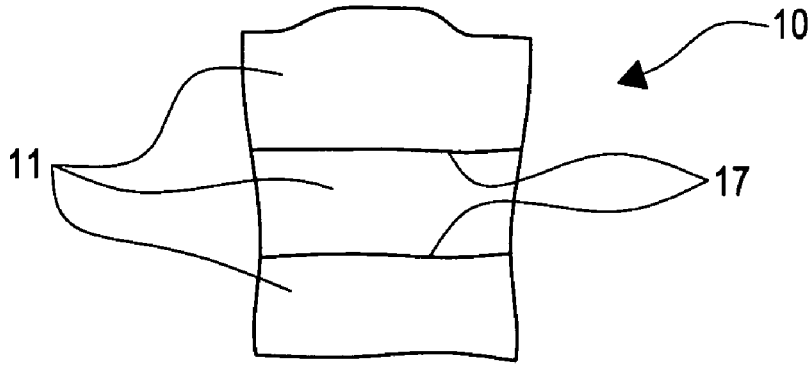
FIG. 1C depicts a rear view of the exemplary vest of FIG. 1A.

The present invention is directed to single-use vests, as well as, multiple-use, launderable vests as described below. An exemplary vest of the present invention is shown in FIGS. 1A-1C. As shown in FIGS. 1A-1C, exemplary vest 10 comprises one or more sheet materials 11, collar 12, and one or more seams 17 for connecting separate sheet materials 11 to one another. FIG. 1A depicts a frontal view of exemplary vest 10. FIG. 1B depicts a side view of exemplary vest 10, while FIG. 1C depicts a rear view of exemplary vest 10. As shown in FIGS. 1A-1C, exemplary vest 10 is of a size to substantially cover a wearer's torso (not shown).

The vests of the present invention may be a pull-over type vest (as shown in FIGS. 1A-1C). In this embodiment, one or more seams 18 (see FIG. 1B) may be used to attach one or more sheet materials 11 together underneath a wearer's arms (not shown). In other embodiments, the vest may comprise one or more closure systems to temporarily attached portions of the vest to one another as described below in FIGS. 2A-2D. The closure system may be present underneath a wearer's arms, on a front portion of the vest (i.e., such as buttons on a shirt), or a combination of vest locations.

a. Single-Use Vests

The present invention is directed to single-use vests comprising one or more of the above-mentioned components. The single-use vests of the present invention may comprise any of the above-mentioned water-soluble materials alone or in combination with water-insoluble materials. The single-use vests desirably comprise at least 50 parts by weight (pbw) of water-soluble materials, based on a total weight of the single-use vest as described above.

Desirably, the single-use vests comprise at least 50 pbw of water-soluble materials, based on a total weight of the single-use product. More desirably, the single-use vests consist essentially of water-soluble materials. Even more desirably, the single-use vests consist solely of water-soluble materials. In one desired embodiment of the present invention, the single-use vests comprise one or more sheets of spunlaced nonwoven fabric formed from polyvinyl alcohol fibers and having a basis weight of up to about 100 grams per square meter (gsm), more desirably, from about 50 to about 80 gsm, even more desirably, about 65 gsm.

Typically, the single-use vests of the present invention comprise "unwashed" sheets of material. In other words, the vests are typically prepared from one or more sheets of material as described above, packaged for a period of time during storage and/or transportation to a use location, opened (i.e., unpackaged), and then used for a particular purpose. For single-use vests, it is not necessary for the single-use vest to be washed during manufacture or prior to use.

The single-use vests may be colorless, dyed or printed using conventional dyes and/or colorants. In one embodiment, at least a portion of the single-use vest is dyed or printed.

b. Multiple-Use Launderable Vests

The present invention is also directed to multiple-use, launderable vests comprising water-soluble material. The launderable vest may be sold as an unwashed vest or as a pre-washed vest. As used herein, the term "pre-washed" is used to describe vests (i) that have been washed at least one time, typically, only one time, and (ii) that have not yet been used for a particular purpose (i.e., the vest has not been exposed to contaminants). The launderable vest is desirably capable of being washed in an aqueous bath (under washing condition such that the water-soluble material does not become soluble as described below) up to about 20 times without negatively impacting the structural integrity of the vest. Typically, the launderable vest is washed up to about 10 times before disposing of the launderable vest.

The launderable vest desirably comprises polyvinyl alcohol with or without acetyl groups, cross-linked or uncross-linked. The launderable vest may consist essentially of water-soluble material, or may consist of water-soluble material. The vest may comprise one or more of the following components: (a) one or more fabric and/or film sheets joined to one another with (b) one or more sheet fastening devices; (c) a closure system used to connect adjacent sheets of fabric and/or film material to one another; (d) one or more pockets; and (e) an optional wash marker indicator, which indicates the number of wash cycles that the vest has experienced. Suitable fabric and/or film sheets include, but are not limited to, nonwoven fabric sheets, woven fabric sheets, knitted fabric sheets, film sheets, and combinations thereof as described above.

Desirably, the launderable vest and all of its components (i.e., sheets, sheet fastening devices, closure systems, wash marker indicators, and pockets) comprise water-soluble material, water-dispersible material, or a combination thereof. More desirably, the vest and all of its components consists essentially of water-soluble material or water-dispersible material. Even more desirably, the vest and all of its components consist of water-soluble material or water-dispersible material.

The launderable vest may be pre-treated with a chemical treatment to enhance one or more properties selected from impermeability, permeability, flame resistance, moisture vapor permeability, tear strength, and stain resistance.

The launderable vest may be colorless, dyed or printed using conventional dyes and/or colorants. In one embodiment, at least a portion of the launderable vest is dyed or printed.

3. Specialty Vests

The present invention is also directed to single-use and multiple-use, launderable vests described below as specialty vests.

a. Ice Vests

Figure 2A:
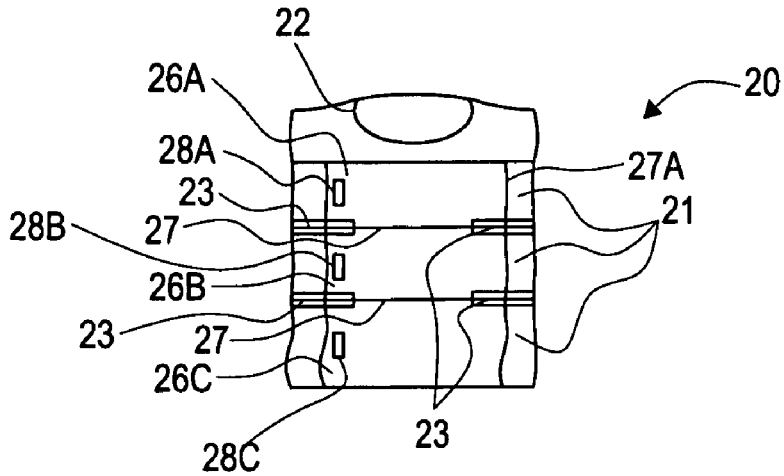
FIG. 2A depicts a frontal view of an exemplary ice vest of the present invention.
Figure 2B:
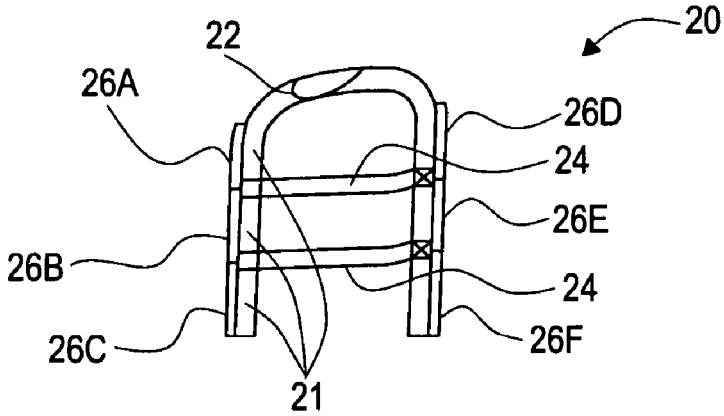
FIG. 2B depicts a side view of the exemplary ice vest of FIG. 2A.
Figure 2C:
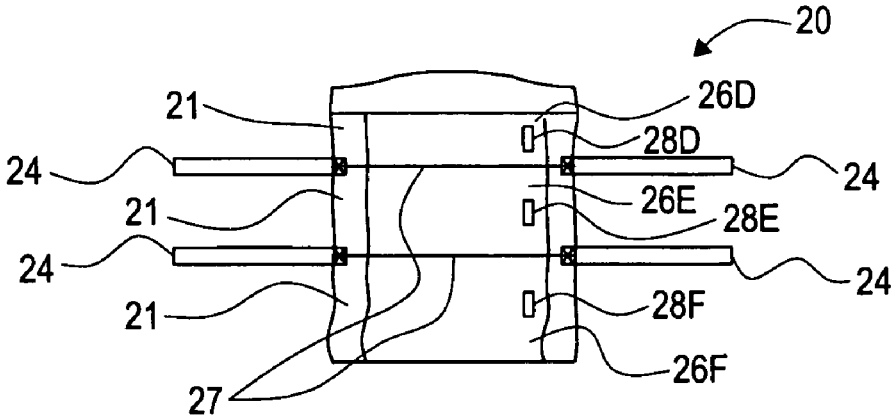
FIG. 2C depicts a rear view of the exemplary ice vest of FIG. 2A.
Figure 2D:
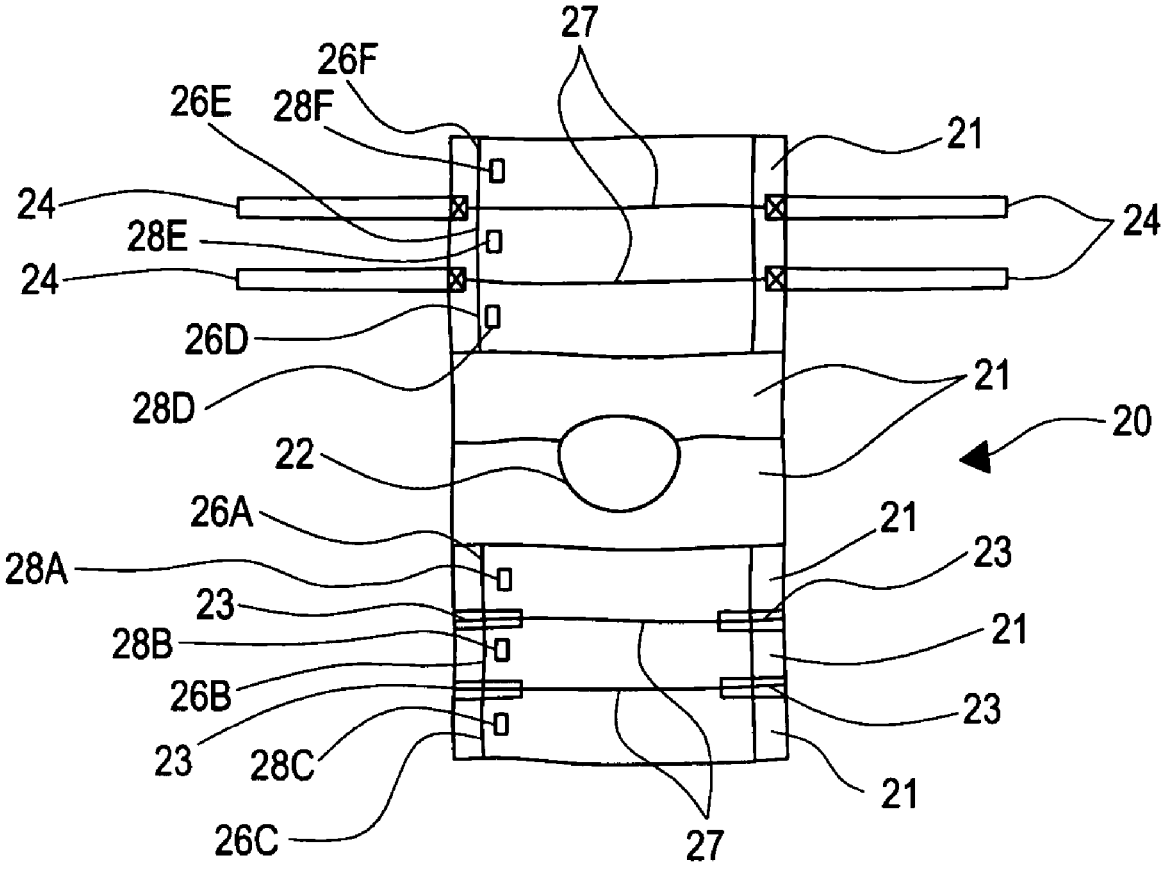
FIG. 2D depicts an elevated frontal view of the exemplary ice vest of FIG. 2A spread flat on a surface.

In one desired embodiment of the present invention, the single-use or multiple-use, launderable vest comprises an ice vest. An exemplary ice vest is shown in FIGS. 2A-2D. As shown in FIGS. 2A-2D, exemplary vest 20 comprises one or more sheet materials 21, collar 22, one or more seams 27 for connecting separate sheet materials 21 to one another, hook materials 23, loop materials 24, pockets 26*a*-26*f*, and pocket closure systems 28*a*-28*f*. FIG. 2A depicts a frontal view of exemplary vest 20; FIG. 2B depicts a side view of exemplary vest 20; FIG. 2C depicts a rear view of exemplary vest 20; and FIG. 2D depicts an elevated frontal view of exemplary vest 20.

Exemplary ice vest 20 may be sized to substantially cover a wearer's torso. Exemplary ice vest 20 may have a width of up to about 178 cm (70 in.), and a length (as measured in a vertical direction) of up to about 152 cm (60 in.).

As shown in FIGS. 2A-2D, exemplary ice vest 20 comprises six pockets 26*a*-26*f* and six pocket closure systems 28*a*-28*f*. Each pocket is sized to hold one or more pieces of ice or dry ice so that a user is cooled while wearing the ice vest and performing a particular task. Each of six pockets 26*a*-26*f* extends across the width of exemplary vest 20. For example, pocket 26*a* extends from pocket closure systems 28*a* to seam 27*a*. Each pocket may have dimensions such that a plurality of pockets substantially covers the front and back surfaces of exemplary vest 20.

It should be noted that the ice vests of the present invention may comprise one or more pockets. Further, it should be noted that the ice vests of the present invention may comprise pocket closure systems other than a hook and loop closure system as shown in FIGS. 2A-2D. Other suitable pocket closure systems include, but are not limited to, closure systems described above.

In one desired embodiment of the present invention, the ice vest comprises the following specifications:

(1) a design as shown in FIGS. 2A-2D;
(2) sheet materials 21 formed from spunlaced nonwoven fabric comprising polyvinyl alcohol fibers and having a basis weight of about 65 gsm;
(3) six pockets arranged similar to pockets 26*a*-26*f;*
(4) pocket material comprising spunlaced nonwoven fabric formed from polyvinyl alcohol fibers and having a basis weight of about 65 gsm;
(5) each pocket having the following dimensions: width (as measured in the vertical direction, i.e., the smaller dimension)—at least about 16.5 cm (6.5 in.), length (as measured across the width of the vest, i.e., the larger dimension)—at least about 40.6 cm (16 in.);
(6) hook and loop pocket closure systems similar to pocket closure systems 28*a*-28*f;*
(7) hook and loop pocket closure systems formed from water-insoluble materials, water-soluble materials, or water-dispersible materials as described above;
(8) loop straps having the following dimensions: width—about 2.54 cm (1 in.), length—about 33.0 cm (13 in.);
(9) hook materials having the following dimensions: width—about 2.54 cm (1 in.), length—about 20.3 cm (8 in.); and
(10) polyester thread (e.g., 40/2 PET thread) for attaching sheet materials 21 to one another, and attaching hook and loop materials to the one or more sheet materials 21.

b. Dosimetry Vests

Figure 3A:
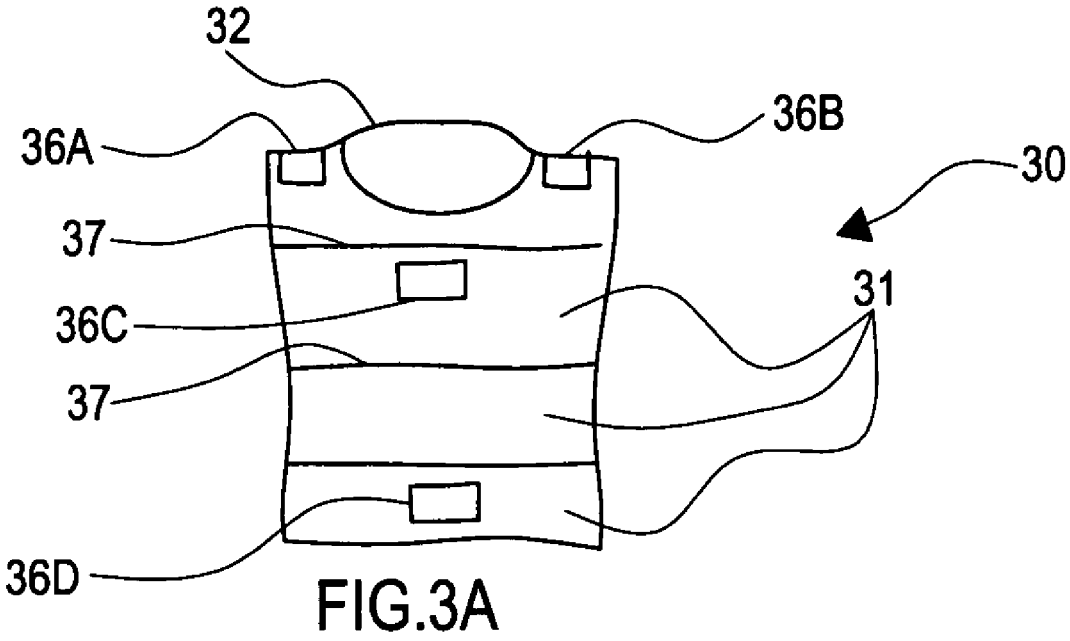
FIG. 3A depicts a frontal view of an exemplary dosimetry vest of the present invention.
Figure 3B:
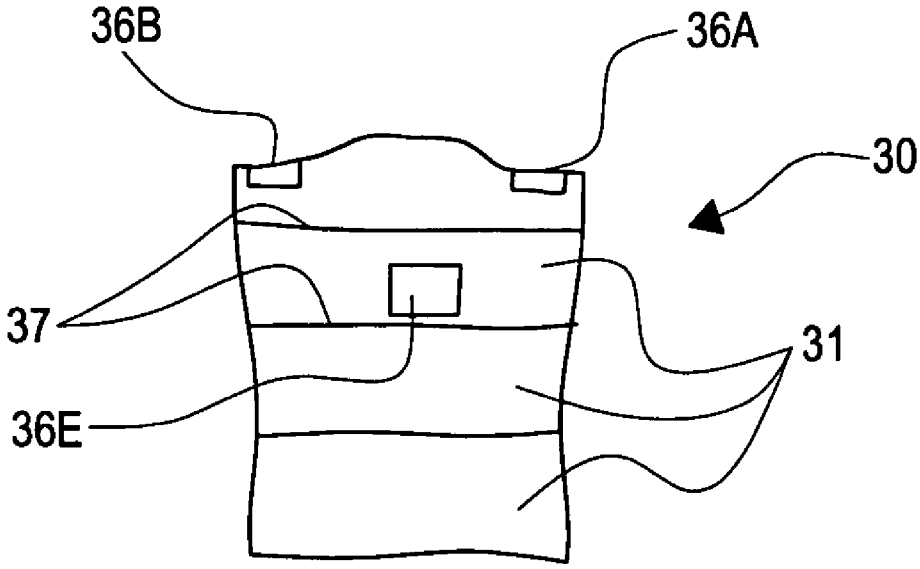
FIG. 3B depicts a rear view of the exemplary dosimetry vest of FIG. 3A.

In a further desired embodiment of the present invention, the single-use or multiple-use, launderable vest comprises a dosimetry vest. An exemplary dosimetry vest is shown in FIGS. 3A-3B. As shown in FIGS. 3A-3B, exemplary dosimetry vest 30 comprises one or more sheet materials 31, collar 32, one or more seams 37 for connecting separate sheet materials 21 to one another, and pockets 36*a*-36*e*. Pockets

36*a*-36*e* may comprise pocket closure systems (not shown) such as those described above. FIG. 3A depicts a frontal view of exemplary dosimetry vest 30; and FIG. 3B depicts a rear view of exemplary dosimetry vest 30.

As shown in FIGS. 3A-3B, pockets 36*a*-36*e* are located in the following locations: pockets 36*a*-36*b* are located along the shoulders of a wearer (not shown); pocket 36*c* is located in the chest area of exemplary dosimetry vest 30; pocket 36*d* is located in the lower stomach area of exemplary dosimetry vest 30; and pocket 36*e* is lcoated on the back of exemplary dosimetry vest 30. It should be noted that any number of pockets may be used on dosimetry vest 30, and the pockets may be arranged in any location on dosimetry vest 30 other than those shown in FIGS. 3A-3B.

The dosimetry vests of the present invention may have dimensions and vest components similar to those described above with regard to the exemplary ice vests.

B. Other Water-Soluble Products

The present invention is further directed to water-soluble products other than vests including, but not limited to, surgeon's caps, utility aprons, perforated wipes, spill socks, sample bags formed from a water-soluble film, waste bags, spill mats and pads, and glove liners.

1. Single-Use Water-Soluble Products

Single-use water-soluble products of the present invention include, but are not limited to, surgeon's caps, utility aprons, perforated wipes, spill socks, sample bags formed from a water-soluble soluble film, waste bags, spill mats and pads, and glove liners. The single-use products comprise one or more pieces of water-soluble material typically in the form of a nonwoven fabric, a woven fabric, a film, or a combination thereof. The water-soluble material may comprise any of the above-described water-soluble materials. Desirably, the single-use products comprise polyvinyl alcohol.

a. Single-Use Water-Soluble Products Formed from Nonwoven and Woven Fabrics

The following single-use products of the present invention comprise nonwoven fabric containing water-soluble fibrous material: surgeon's caps, utility aprons, perforated wipes, spill socks, and spill mats and pads. The following single-use products of the present invention comprise woven fabric containing water-soluble fibrous material: glove liners. The water-soluble fibrous material may comprise any of the above-described water-soluble materials. Desirably, the single-use products comprise nonwoven or woven fabric comprising polyvinyl alcohol.

The single-use water-soluble surgeon caps, utility aprons, spill socks, splash-resistant coveralls, and glove liners of the present invention may include one or more of the following features, similar to the above-described vests: water-insoluble material in amounts as described above, one or more sheet fastening devices to connect one or more fabric and/or film sheets to one another, and one or more sheet closure systems to temporarily attach a first section of the product to a second section of a product.

In one desired embodiment of the present invention, the single-use water-soluble surgeon caps, utility aprons, and spill socks, comprise one or more sheets of spunlaced nonwoven fabric formed from polyvinyl alcohol fibers and having a basis weight of up to about 100 grams per square meter (gsm), more desirably, from about 50 to about 80 gsm, even more desirably, about 65 gsm.

Similar to the launderable vests described above, the single-use water-soluble surgeon caps, utility aprons, spill socks, and glove liners may be pre-treated with a chemical treatment to enhance one or more properties selected from impermeability, permeability, flame resistance, moisture vapor permeability, tear strength, and stain resistance.

The single-use water-soluble spill mats and pads of the present invention typically comprise an outer layer of nonwoven fabric, which envelopes shredded nonwoven fabric filler material. Desirably, the outer layer of nonwoven fabric and the shredded nonwoven fabric filler material comprises spunlaced nonwoven fabric formed from polyvinyl alcohol fibers and having a basis weight of up to about 100 grams per square meter (gsm), more desirably, from about 50 to about 80 gsm, even more desirably, about 65 gsm.

b. Single-Use Water-Soluble Products Formed from Films

The following single-use products comprise a water-soluble film: sample bags and waste bags. Typically, the sample bags comprise one or more films of water-soluble material having a film thickness of up to about 76 microns (3 mil), more desirably, about 40.6 microns (1.6 mil). The sample bag is sealed on all sides except for a bag opening for inserting material into and removing material from the sample bag. Typically, the sample bags have a rectangular shape and dimensions (i.e., length and width) of up to about 152 cm (60 inches). The sample bags of the present invention may further comprise one or more of the following features, similar to the above-described vests: water-insoluble material in amounts as described above, and one or more closure systems to temporarily seal the sample bag.

Typically, the waste bags comprise one or more films of water-soluble material having a film thickness of up to about 76 microns (3 mil), more desirably, about 40.6 microns (1.6 mil). The waste bag is sealed on all sides except for a bag opening for inserting material into and removing material from the waste bag. Typically, the waste bags have a rectangular shape and dimensions (i.e., length and width) of up to about 152 cm (60 inches). The waste bags of the present invention may further comprise one or more of the following features, similar to the above-described vests: water-insoluble material in amounts as described above, and one or more closure systems to temporarily seal the waste bag.

2. Multiple-Use Water-Soluble Products

Multiple-use water-soluble products of the present invention include, but are not limited to, scrubs, labcoats and modesty garments. The multiple-use products comprise one or more pieces of water-soluble material typically in the form of a nonwoven fabric, a woven fabric, a film, or a combination thereof. The water-soluble material may comprise any of the above-described water-soluble materials. Desirably, the multiple-use products comprise nonwoven fabric comprising polyvinyl alcohol.

The multiple-use water-soluble scrubs, labcoats and modesty garments of the present invention may include one or more of the following features, similar to the above-described vests: water-insoluble material in amounts as described above, one or more sheet fastening devices to connect one or more fabric and/or film sheets to one another, one or more sheet closure systems to temporarily attach a first section of the garment to a second section of a garment, a wash marker indicator to indicate how many wash cycles the garment has been exposed to, and pockets.

The multiple-use water-soluble scrubs, labcoats and modesty garments of the present invention may be sold as an unwashed product or as a pre-washed product, both of which are described above. In one desired embodiment of the present invention, the multiple-use water-soluble scrubs, labcoats and modesty garments comprise unwashed products or pre-washed products comprising one or more sheets of spunlaced nonwoven fabric formed from polyvinyl alcohol fibers and having a basis weight of up to about 100 grams per square meter (gsm), more desirably, from about 50 to about 80 gsm, even more desirably, about 65 gsm.

Similar to the launderable vests described above, the multiple-use water-soluble scrubs, labcoats and modesty garments may be pre-treated with a chemical treatment to enhance one or more properties selected from impermeability, permeability, flame resistance, moisture vapor permeability, tear strength, and stain resistance.

II. Methods of Washing Products Containing Water-Soluble Material

The present invention is also directed to methods of removing one or more contaminants from a multiple-use, launderable product containing water-soluble material, wherein the method comprises washing the product in an aqueous bath under washing condition such that the water-soluble material does not become soluble. The method finds particular utility in the medical and nuclear industries for removing contaminants, such as bio-hazardous or radioactive waste from a product. As discussed above, multiple-use, launderable products containing water-soluble material include, but are not limited to, vests, scrubs, labcoats and modesty clothing.

The method may include two or more washing steps, wherein the multiple-use, launderable product is used repeatedly between washing steps. Desirably, the product may be reused and washed up to about 20 times. In some exemplary embodiments of the present invention, the product is used a limited number of times (i.e., reused and washed a limited number of times). In some cases, the product is reused and washed up to about 10 times.

The washing step may be performed using commercially available washing machines. Suitable washing machines include, but are not limited to, washing machines available from Pellerin Milnor Corporation (Kenner, La.). Examples of suitable washing machines include, but are not limited to, washing machines available from Pellerin Milnor Corporation having a desired load capacity. Desirably, the washing machine has a load capacity (i.e., weight of vests, not vests with water) of at least about 45 kilograms (kg) (100 lbs.), more desirably, at least about 113 kilograms (kg) (250 lbs.), even more desirably, at least about 227 kilograms (kg) (500 lbs.).

The washing step is performed under conditions such that the water-soluble material does not become soluble. Desirably, the aqueous bath has a bath temperature of less than about 90° C. during the washing step. More desirably, the aqueous bath has a bath temperature of less than about 75° C., even more desirably, less than about 50° C., and even more desirably, less than about 37° C. during the washing step. In one desired embodiment of the present invention, the aqueous bath has a bath temperature of about 15° C. during the washing step.

The washing step uses an aqueous bath. The aqueous bath may comprise water alone or in combination with one or more additional components. In addition to water, the aqueous bath may include one or more additional components including, but not limited to, surfactants, detergents or other cleaning agents. Commercially available detergents may be used in the washing step. An example of a suitable surfactant is E-500 commercially available from Paragon Corporation (Birmingham, Ala.). An example of a suitable detergent is ASSERT brand detergent, also commercially available from Paragon Corporation (Birmingham, Ala.).

The method of removing one or more contaminants from a multiple-use, launderable product containing water-soluble material is suitable for removing a variety of contaminants. Exemplary contaminants include, but are not limited to, radioactive material, infectious waste, bio-hazardous waste, industrial waste containing petroleum-based contaminants, or a combination thereof. As used herein, the term "radioactive material" includes, but is not limited to, a transuranic element, a fission product, a natural radioactive element, an activation product from a nuclear process, a medical isotope, or a combination thereof.

The method of removing one or more contaminants from a multiple-use, launderable product containing water-soluble material may comprise one or more additional steps in addition to the above-described washing step. Suitable additional steps include, but are not limited to, soaking and/or agitating the product or aqueous bath during the washing step; dry cleaning the product; extracting water from the product; drying the product; monitoring the product to detect the presence of one or more contaminants (e.g., radioactive material); and marking the product in some manner to identify how many washing cycles the product has experienced. For example, the step of monitoring a washed product (i.e., a conventional washed product formed from water-insoluble material, not water-soluble material) to detect the presence of one or more contaminants is a standard procedure in the nuclear industry. Suitable marking steps include, but are not limited to, removing a detachable portion of the product, punching a hole in the product corresponding to the number of washed, and applying a tag to the product.

Once the product is washed, the product is further processed to remove water from the product. In one exemplary method, the product is centrifuged in a commercial centrifuge apparatus at a centrifugal force of from about 200 to about 220 g for a period of time to remove excess water from the product. Typically, the product is centrifuged in such an apparatus for about 2 to about 4 minutes to remove excess water from the product. The product may be centrifuged in a separate commercial apparatus or may be centrifuged in the above-mentioned washing machines.

After a centrifuge step, the product may be dried in a commercial dryer. Suitable commercial dryers include, but are not limited to, commercial dryers available from Cissell Manufacturing Company (Louisville, Ky.) and having a load capacity similar to the commercial washing machines described above. Desirably, the product is dried at a drying temperature of at least 38° C. (100° F.) for a sufficient time to remove residual water. Drying temperatures may be greater than 38° C. (100° F.), such as at least 49° C. (120° F.), at least 60° C. (140° F.), at least 71° C. (160° F.), at least 91° C. (195° F.), and as high as 104° C. (220° F.). Drying times may be greater than 30 minutes at lower temperatures, such as temperatures less than about 60° C. (140° F.). At higher temperatures, the drying time may be below 30 minutes. Desirably, the drying time is less than about 20 minutes, and as little as 10 minutes.

In one embodiment of the present invention, the method of removing one or more contaminants from a multiple-use, launderable product containing water-soluble material comprises (i) washing the product in an aqueous bath under washing condition such that the water-soluble material does not become soluble; (ii) optionally, agitating the product or aqueous bath during the washing step; (iii) extracting water from the washed product (e.g., centrifuging the product); (iv) drying the washed product; (v) using the washed product for a particular purpose, wherein the particular purpose exposes the washed product to one or more contaminants; and (vi) repeating steps (i) to (v) as needed.

The above-described method of removing one or more contaminants from a multiple-use, launderable product containing water-soluble material is useful in a variety of applications, and is particularly useful in the nuclear or medical industry, wherein the one or more contaminants comprise radioactive waste, infectious waste, bio-hazardous waste, or a combination thereof. Further, the above-described method of removing one or more contaminants from a multiple-use, launderable product containing water-soluble material may be useful for each of the exemplary limited reusable, water-soluble products including, but are not limited to, vests, labcoats, scrubs, and modesty clothing III. Washed Products Containing Water-Soluble Material As discussed above, the multiple-use, launderable products may be pre-washed (i.e., a launderable product, such as a vest, washed at least once, but not yet used for a particular purpose or exposed to contaminants) using a method as described above. The pre-washed launderable product is substantially free of lint and static. Further, the pre-washed product is free of substantial shrinkage during subsequent washing/drying cycles. During the initial wash/dry cycle, the materials used to form the launderable products may shrink as much as 20%. For example, launderable products formed from spunlaced nonwoven fabrics of PVA fibers typically have a shrinkage of up to about 16% during an initial wash/dry cycle. Such initial shrinkage drastically changes the original size (i.e., the size before washing) of the launderable product, which potentially causes problems for the user. In order to avoid these potential problems, (i) the launderable product itself is either pre-washed or (ii) the sheets of material used to form the launderable product are pre-shrunk (i.e., washed/dried) prior to being incorporated into the launderable product.

Shrinkage within a product may be measured between any two points on the product. Typical ways to measure product shrinkage include measuring the amount of shrinkage between any two points on the product. For example, in the case of a vest, vest shrinkage may be measured: (a) horizontally across the back of the vest; and/or (b) vertically from the back collar seam to the waistline. Desirably, the pre-washed launderable product or the pre-shrunk launderable product has a cumulative shrinkage of less than about 10% between any two points on the product during a second or subsequent washing cycle (i.e., up to 20 washing cycles). In other words, the pre-washed launderable product or the pre-shrunk launderable product desirably has a shrinkage of less than about 10% between any two points on the product during the life of the product after the initial wash cycle. More desirably, the pre-washed launderable product or the pre-shrunk launderable product has a cumulative shrinkage of less than about 5% between any two points on the product during a second or subsequent washing cycle (i.e., up to 20 washing cycles).

The above-described method of removing one or more contaminants from a product containing water-soluble material results in a pre-washed or washed product, which is substantially free of contaminants. The pre-washed product may be used for the first time and reused after a second or subsequent washing. The washed products may be reused after washing. The reusable, pre-washed and washed products are desirable to workers due to their safe, substantially contaminant-free washed condition.

For example, in the nuclear industry, reusable cotton or cotton blend products, such as cotton or cotton blend vests, are washed and reused by workers. Reusable garments are monitored prior to reusing the garment to minimize exposure of workers to radioactive material. A measurement of disintegrations per minute (dpm) is used to determine the degree of exposure to radioactive material. A laundry monitor, typically referred to as an "Automated Laundry Monitor" or "ALM", is used to measure the amount of residual radioactive contamination in disintegrations per minute or "dpm". Typically, the laundry monitoring step comprises a procedure, wherein a garment or other product is placed on a wire mesh conveyor belt having a width of about 150 to 180 cm. The garment is spread out on the conveyor belt, which passes between two sets of radiation detectors, with one row of detectors above the belt and another row of detectors below the belt. The detectors may be beta detectors, gamma detectors, or both. Alarm setpoints are set prior to processing each customers clothing. If an item alarms the detector, the item is removed and rewashed and monitored again. If the item fails the second monitoring step, the item is placed in a bag and marked as rejected and returned to a customer.

Currently, reusable cotton or cotton blend products, such as vests, typically measure between about 50,000 to about 100,000 dpm on an ALM after washing and prior to reuse. The washed and pre-washed products of the present invention provide much lower measurements, which prior to the present invention, had not been achievable in the nuclear industry. The washed PVA-containing products of the present invention measure less than about 25,000 dpm on the same ALM. Desirably, the washed PVA-containing products of the present invention measure less than about 5,000 dpm on the same ALM, and more desirably, from about 1,000 dpm to about 5,000 dpm on the same ALM.

IV. Methods of Disposing of Products Containing Water-Soluble Material

The present invention is further directed to methods of disposing of any of the above-described multiple-use and single-use products containing water-soluble materials. The methods of disposing of multiple-use and single-use products will depend on the types of contaminants present on the multiple-use or single-use product at the time of disposal. For example, if the contaminants are household dirt or unregulated materials, the method of disposing of the product may comprise a disposal step, wherein the product dissolves during the disposal step, and the remains of the product, if any, are discarded with the wash bath or removed from a washing machine and discarded. An exemplary method comprises the following steps:

(1) exposing the product to an aqueous environment for a period of time and at a temperature that causes the water-soluble material of the product to dissolve; and (2) discarding any undissolved components.

The above-described method may further comprise one or more of the following steps:

(i) placing the single-use or multiple-use product into a disposal apparatus;

(ii) introducing water into the disposal apparatus to form a solution;

(iii) introducing a pH adjusting agent, such as an acid (e.g., acetic acid) or a base (e.g., sodium hydroxide), to the solution;

(iv) adding a degradation-enhancing reactant or a precursor of a degradation-enhancing reactant to the solution;

(v) heating the aqueous solution so as to react the precursor to form the degradation-enhancing reactant, if necessary, and reacting with the water-soluble polymer to form one or more degradation products;

(vi) optionally, filtering non-solubilized material from the aqueous environment; and (vii) optionally, measuring a parameter indicator of the concentration of polymer material in the aqueous environment.

For other types of contaminants, such as contaminants in the medical and/or nuclear industries, the methods of disposing of the multiple-use and single-use products may comprise multiple steps in order to separate and control the handling of the contaminants, as well as, the water-soluble materials of the multiple-use and/or single-use product. When one or more contaminants comprise radioactive material, the method of disposing of the multiple-use or single-use product is desirably one of the methods disclosed in U.S. patent application Ser. No. 09/863,014, filed on May 23, 2001; International Publication No. WO 01/36338 corresponding to PCT Application No. PCT/US00/26553; and PCT Application No. PCT/US02/16184, filed on May 22, 2002; the disclosures of all of which are hereby incorporated in their entirety by reference. In these methods of disposal, the method may include one or more of the following steps:

(1) placing the single-use or multiple-use product into a disposal reactor;

(2) introducing water into the reactor to form a solution;

(3) introducing a pH adjusting agent, such as an acid (e.g., acetic acid) or a base (e.g., sodium hydroxide), to the solution;

(4) adding a degradation-enhancing reactant or a precursor of a degradation-enhancing reactant to the solution;

(5) heating the aqueous solution so as to react the precursor to form the degradation-enhancing reactant, if necessary, and reacting with the water-soluble polymer to form one or more degradation products;

(6) optionally, filtering non-solubilized material from the aqueous environment;

(7) optionally, measuring a parameter indicator of the concentration of polymer material in the aqueous environment;

(8) optionally, filtering material, e.g., radioactive material, from the aqueous environment;

(9) optionally, altering, e.g., neutralizing, the pH of the aqueous environment;

(10) optionally, biodegrading the resulting degradation products in the aqueous environment, e.g., organic acids form $CO_2$, $H_2O$ and biomass; and

(11) removing any insoluble components from the reactor.

Suitable degradation-enhancing reactants or precursors thereof include, but are not limited to, oxidizing agents such as $H_2O_2$, $Fe^{+3}$, $Cu^{+2}$, $Ag^+$, $O_2$, $Cl_2$, $ClO^-$, $HNO_3$, $KMnO_4$, $K_2CrO_4$, $K_2Cr_2O_7$, $Ce(SO_4)_2$, $K_2S_2O_8$, $KIO_3$, ozone, peroxides, or any combination thereof. In embodiments employing hydrogen peroxide as an oxidizing agent, the concentration of the hydrogen peroxide can be at least 5%, 10%, 15%, 20%, 25%, 30%, 35%, 40%, 45%, 50%, 55%, 60%, 65%, 70%, 75%, 80%, 85%, 90%, or 95%. However, in a desired embodiment, the hydrogen peroxide used is commercially available 30-35% hydrogen peroxide. A specific example of hydrogen peroxide suitable for use in the present invention is commercially available as CAS No. 7722-84-1, and may be purchased from a number of sources including VWR Scientific Products, West Chester, Pa. 19380, Catalog No. VW 9742-1.

In one desired embodiment of the present invention, the method of diposal comprises heating an aqueous solution containing the multiple-use product and/or single-use product and a degradation-enhancing reactant/precursor, e.g., oxidizing agent, at a temperature and length of time sufficient to dissolve the water-soluble polymer within the multiple-use product and/or single-use product and react the oxidizing agent. Desirably, the aqueous solution is heating to a temperature of at least about 82.2° C. (180° F.), more desirably, at least about 87.8° C. (190° F.), even more desirably, at least about 93.3° C. (200° F.), and even more desirably, at least about 100° C. (212° F.). This may be accomplished by pressure-cooking the solution in a bath of high-temperature water at a constant volume, such as by autoclaving. The vessel containing the aqueous solution and multiple-use product and/or single-use product may be desirably heated to a temperature in a range of between about 100° C. (212° F.) to about 121° C. (250° F.) under saturation pressure. Typically, the aqueous solution is maintained at the elevated temperature (i.e., at least about 82.2° C. (180° F.)) for a period of time of up to about 2 hours. In most cases, the aqueous solution is maintained at an elevated temperature (i.e., at least about 82.2° C. (180° F.)) for a period of time of about 30 minutes to about 90 minutes, and usually about 60 minutes.

Pressure-cooking the aqueous solution and multiple-use product and/or single-use product in this manner enables higher solution temperatures than can be achieved in ambient air without boiling. The higher temperature of the solution transfers more heat energy to the solid polymer material, and the increased heat energy more effectively penetrates solid masses of polymer materials to dissolve them completely. Further, the higher temperatures of the autoclave achieve a sterilization of the waste stream that cannot be achieved at lower temperatures. The high temperature used in pressure-cooking the water-soluble polymer solution is sufficient to cause chemical decomposition of the oxidizing agent, especially in the presence of up to about 100 ppm of a Fenton Reagent. For example, when the oxidizing agent is hydrogen peroxide, the higher temperature is sufficient to produce hydroxyl radicals, molecular oxygen or a combination of both. When up to about 100 ppm of a Fenton Reagent is used in combination with hydrogen peroxide, the production of hydroxyl radicals, molecular oxygen or a combination of both and the degradation of polymer is greatly enhanced, decreasing the reaction time needed to degrade the polymer.

The aqueous contents of the reactor vessel are desirably filtered through strainers to remove any undissolved polymer material and water-insoluble polymer constituents in the solution. In a desired embodiment, the strainers will have a mesh size in an approximate range of between about 20 and about 50 mesh. In a more desired embodiment, the strainers will have a mesh size of approximately about 30 mesh. Undissolved polymer material trapped in the strainers may be recirculated for final solubilization. In a desired embodiment, polymer material will constitute an approximate range of greater than 0% to about 10.0% by weight in the solution. In a more desired embodiment, polymer material will constitute an approximate range of between about 4.0% to about 6.0% by weight in the solution. In still a more desired embodiment, polymer material will be present in an amount of about 5.0% by weight in the solution. Additionally, in the one desired embodiment, the temperature of the solution during the filtration process step is maintained at or above about 66° C. (150° F.), more desirably, above about 82.2° C. (180° F.), to prevent precipitation of the PVA out of solution prior to its destruction.

The polymer may be destroyed by a reaction, e.g., an oxidation-reduction reaction that converts the polymer material into different organic compounds that do not exhibit the same physical or chemical characteristics of the original polymer material. The characteristics of these compounds can be used to determine the extent of the reaction. This step is only necessary when it is necessary to determine the progress or completion of the destruction of the polymer material in the solution. For example, when the polymer is PVA and the degradation-enhancing reactant/precursor is hydrogen peroxide, the resultant solution will include water and organic acids, such as acetic acid. Thus, the pH of the resultant solution will decrease measurably during PVA oxidation. The degree of completion of the reaction can be measured by the decrease of the pH of the solution. A complete reaction (complete destruction of the PVA in solution) can be indicated by a pH below at least about 6.0, alternatively below at least 5.0, or even below at least 4.0, still alternatively below at least 3.0 or even below at lest 2.0. Similarly, the corresponding decrease in the pH can be between about 1.0 units to about 6.0 units below the pH of the solubilized solution. In an alternative embodiment, the desired decrease in pH is between about 2.7 units to about 3.9 units below the pH of the solubilized solution.

Alternatively, the destruction of PVA may be confirmed by colorimetric assay of the PVA concentration in solution. Measurement by calorimetric assay may also be done in combination with measurements of pH. Note Amended Assay by Joseph H. Finley, "Spectrophotometric Determination of Polyvinyl Alcohol in Paper Coatings," *Analytical Chemistry* 33(13) (December 1961), and the calorimetric iodine solutions taught therein, including a desired solution using 12.0 g boric acid, 0.76 g iodine and 1.5 g potassium iodide per liter. Desirably, spectrophotometric measurement of the polyvinyl alcohol occurs at its absorption maximum of 690 nm. The assay may be completed by: placing 20.0 ml calorimetric iodine solution in cuvette; adding 0.5 ml sample; incubating the solution at 25° C. for five minutes. Spectrophotometric measurement can be made at the absorption maximum, 690 nm using a Hach DR2010 or Odysey DR2500 spectrophotometer. Standard solutions of polyvinyl alcohol may be prepared and a standard curve prepared using up to 10.0% concentrations of PVA in solution. The calibration curve may be derived from the absorption values at 690 nm (at 25° C.) plotted against the quantity of PVA per assay.

The disposal method may also include at least one filtering step when radioactive material is present in the solution. If the single-use or multiple-use product is exposed to radioactivity during a particular use, a filtering step to remove at least a portion of the radioactive material is desirably added to the disposal process. With the addition of this process step, a low-level radioactive waste management system is created. The present waste management system may be used as an alternative approach to current dry active radioactive waste treatment methods.

The process step of removal of at least a portion of the radioactive material typically occurs prior to any biological degradation step, when present. One exemplary process includes the basic steps of:

(a) filtration of the solution, and (b) ion exchange of the solution.

At nuclear facilities, radioactivity may be present in process fluids in both elemental and particulate form. Filtration of the solution removes at least a portion of radioactive particulates. In a desired embodiment, the solution is passed through a particulate filter having a nominal pore size ranging approximately between about 10 and about 100 microns. In a more desired embodiment, the solution is then passed through a second particulate filter having a nominal pore size ranging approximately between about 0.1 micron and about 1.0 micron.

An ion exchange step may be used to deplete the solubilized radioactive species, or solubilized elemental radioisotopes, that remain after microfiltration, making the solution suitable for disposal or further treatment. In a desired embodiment, the solution is directed through an ion exchange vessel that contains ion exchange resin in the form of anion, cation bed or a combination thereof. During this process step, radioactive ions in solution will exchange places with the non-radioactive ions attached to the resin in solid form. The radioactive material collects on the resin, leaving the solution suitable for discharge or reuse as desired.

In one embodiment, the resultant organic acid-containing solution is pH neutralized by addition of a base reagent. In a more desired embodiment, sodium hydroxide is the base reagent used to raise the pH to an approximate range of between about 3.0 and about 10.0. In another more desired embodiment, when the solution is biologically treated such as described below, sodium hydroxide is the base reagent used to increase the pH to within an approximate range of between about 5.0 and about 8.0. It is believed that the sodium hydroxide combines with the acetate of the acetic acid in the solution to form a sodium acetate buffer, which is important to the biodegrading process step. In the most desired embodiment, the pH of the resultant organic acid-containing waste stream is neutralized to within an approximate range of between about 6.0 and about 7.0.

For the purposes of the present invention, the term "altering" refers to adjusting the pH while "neutralization" is intended to mean increasingly adjusting of the pH of an acidic solution to a more basic, less acidic, solution having a pH of approximately between about 3.0 and about 10.0. Desirably, the pH is adjusted to within the approximate range of about 3.0 to about 10.0 prior to any biodegradation step. In a more desired embodiment, it is recommended to adjust the pH to about 7.5 and growing organisms at 25° C. In a more desired embodiment, the solution is directed to a pulverized activated carbon (PAC) chamber comprising an aerated, fluidized bed of PAC. The pulverized carbon becomes a suspended substrate for bacterial growth. When the TOC is reduced to the desired level below local regulatory limitations, the biologically treated solution can be decanted and released for discharge.

The method may also include a step of removing dissolved and colloidal organic carbon compounds that remain in the aqueous stream after oxidation. The neutralized solution of destroyed polymer material has a high carbon compound content that may render the solution unfit for discharge to sanitary sewer systems. Total organic carbon (TOC) is a direct measurement of the concentration of the organic material in solution. Biochemical oxygen demand (BOD) is a measure of the oxygen required for the total degradation of organic material and/or the oxygen required to oxidize reduced nitrogen compounds. Chemical oxygen demand (COD) is used as a measure of the oxygen equivalent of the organic matter content of a sample that is susceptible to oxidation by a strong chemical oxidant. One or more of these parameters are commonly used by publicly operated treatment facilities to regulate effluent waste streams.

Additionally, in instances where the polymer material may contain or have been exposed to radioactivity, it is possible that even after the microfiltration of particulate species and ion exchange depletion of the solubilized radioactive species, the neutralized solution may still contain a level of radioactive material such that the solution is undesirable for disposal or further treatment. Accordingly, depletion of the organic carbon material from solution can further deplete residual radioactive species contained in the neutralized solution.

Biodegradation of the organic acids and other organic products in the solution may be used to (1) deplete and/or remove organic carbon compounds; and (2) further aid in the depletion of residual radioactive material. In this process step, the neutralized solution is inoculated with microorganisms. The microorganisms utilize the organic acids produced by the oxidation-reduction of the water-soluble polymer material as a carbon and energy source. In a desired embodiment, the microorganisms are comprised substantially of aerobic, heterotrophic bacteria. These forms of bacteria are known to those in the art and are readily available.

Further process details related to biodegradation steps suitable for use in the present invention are disclosed in U.S. patent application Ser. No. 09/863,014, filed on May 23, 2001; International Publication No. WO 01/36338 corresponding to PCT Application No. PCT/US00/26553; and PCT Application No. PCT/US02/16184, filed on May 22, 2002; the disclosures of all of which are hereby incorporated in their entirety by reference.

The above-described method of disposing of one or more multiple-use and single-use products containing water-soluble materials may be useful for each of the exemplary multiple-use and single-use products including, but are not limited to, vests, water-soluble surgeon caps, utility aprons, labcoats, perforated wipes, spill socks, splash-resistant coveralls, sample bags formed from a water-soluble film, waste bags, scrubs, modesty clothing, spill mats and pads, and glove liners.

VI. Methods of Reducing Radioactive Waste

The present invention is further directed to methods of reducing an amount of radioactive waste generated by at least one contaminated product. For a single-use product, the method comprises disposing of the contaminated product in an aqueous bath under condition such that at least a portion of the product becomes soluble. For a multiple-use product, the method comprises (a) washing the contaminated product in an aqueous bath under washing condition such that the product does not become soluble; and (b) disposing of the contaminated product in an aqueous bath under condition such that at least a portion of the product becomes soluble. The second method produces a reusable product after washing step (a), and disposes of the reusable product after disposal step (b). The method reduces the amount of radioactive waste by (1) eliminating the volume of radioactive waste associated with conventional reusable products, such as cotton or cotton blend products, which must be disposed of by burying the waste, and/or (2) eliminating the volume of radioactive waste associated with single-use water-soluble products, such as insoluble components (i.e., zippers, thread, etc.), which must also be disposed of by burying the waste.

The methods of reducing an amount of radioactive waste generated by at least one contaminated product may comprise any of the above-described method steps associated with washing the product, and disposing of the components of the product. Desirably, the method comprises two or more washing steps (a), and as many as about 20 washing steps (a). In one embodiment of the present invention, the method comprises up to about 10 washing steps (a).

The method of the present invention may reduce the amount of radioactive waste, as measured by volume reduction, by as much as 10,000 to 1. In other words, the method of the present invention enables 10,000 cubic centimeters (cc) of contaminated (i.e., radioactive) material to be reduced down to about 1 cc of radioactive waste. For comparison, compaction methods typically reduce the volume of radioactive waste by a ratio of about 10 to 1 (i.e., 10 cc of contaminated (i.e., radioactive) material is reduced down to about 1 cc of radioactive waste); and incineration methods typically reduce the volume of radioactive waste by a ratio of about 50 to 1 (i.e., 50 cc of contaminated (i.e., radioactive) material is reduced down to about 1 cc of radioactive waste). The method of the present invention desirably reduces the volume of radioactive waste by a ratio of at least 100 to 1 (i.e., 100 cc of contaminated (i.e., radioactive) material is reduced down to about 1 cc of radioactive waste), more desirably, by a ratio of at least 500 to 1 (i.e., 500 cc of contaminated (i.e., radioactive) material is reduced down to about 1 cc of radioactive waste), and as much as by a ratio of 10,000 to 1 (i.e., 10,000 cc of contaminated (i.e., radioactive) material is reduced down to about 1 cc of radioactive waste).

As described above, each of the washing steps (a) independently has a desirable bath temperature of less than about 90° C., in some cases, less than about 75° C., in other cases, less than about 50° C., and in other cases, less than about 37° C. In addition to water, each of the washing steps (a) independently contains one or more surfactants detergents or other cleaning agents.

In the disposal step, disposal step (b) desirably has a bath temperature of greater than about 37° C., in some cases, greater than about 50° C., in other cases, greater than about 75° C., and in other cases, greater than about 90° C. In addition to water, the disposal step (b) may contain one or more degradation-enhancing reactants, a precursor of a degradation-enhancing reactant, oxidizers, such as ozone, or a combination thereof as described above.

The above-described method is particular useful when the at least one contaminated product comprises one or more multiple-use products comprising water-soluble material as described above, especially multiple-use products comprising polyvinyl alcohol with or without acetyl groups, cross-linked or uncross-linked.

The method is suitable for reducing the amount of radioactive waste generated by at least one contaminated product, wherein the at least one contaminated product is contaminated with radioactive material including, but not limited to, a transuranic element, a fission product, a natural radioactive element, an activation product from a nuclear process, a medical isotope, or a combination thereof.

In one desired embodiment of the present invention, the method of reducing an amount of radioactive waste generated by at least one contaminated product comprises one or more of the following steps:

(a) washing the contaminated product in an aqueous bath under washing condition such that the product does not become soluble;

(b) extracting excess water from the washed product;

(c) drying the washed product;

(d) monitoring the dried product for the presence of one or more radioactive materials;

(e) using the washed product for a particular purpose, wherein the particular purpose exposes the product to one or more radioactive materials;

(f) washing the contaminated product in an aqueous bath under washing condition such that the product does not become soluble;

(g) extracting excess water from the washed product;

(h) drying the washed product;

(j) monitoring the dried product for the presence of one or more radioactive materials;

(j) repeat steps (e)-(j) for a desired number of times (typically less than 20) finishing with either step (e) (i.e., a contaminated product) or with step (f) or (i) (i.e., a washed product);

(k) placing the multiple-use product from step (j) into a disposal reactor;

(k1) introducing water into the reactor to form an aqueous solution;

(k2) adding one or more components to the reaction vessel including, but not limited to, a degradation-enhancing reactant, a precursor to a degradation-enhancing reactant, an oxidizer, such as ozone, a metal catalyst, a Fenton Reagent, or a combination thereof;

(k3) heating the aqueous solution so as to react the precursor to form the degradation-enhancing reactant, if necessary, and reacting with the water-soluble polymer to form degradation products;

(l) maintaining the temperature of the aqueous solution at a temperature above about 82° C. (180° F.) for a period of time to degrade the water-soluble polymer into one or more degradation products;

(m) filtering non-solubilized material from the aqueous solution;

(n) optionally, measuring a parameter indicator of the concentration of polymer material in the aqueous solution;

(o) separating at least a portion of radioactive material from the aqueous solution by a separation technique, such as by filtering;

(p) collecting the radioactive material for proper disposal;

(q) optionally, altering or neutralizing the pH of the aqueous solution substantially free of radioactive material;

(r) biodegrading the resulting degradation products in the aqueous solution substantially free of radioactive material, e.g., organic acids form $CO_2$, $H_2O$ and biomass; and (s) removing any insoluble components from the reactor.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Release Data Comparison Between Cotton/Polyester Blend Fabrics and OREX™ PVA Fabrics Contamination release testing was conducted at an Eastern Technologies, Inc. (ETI) facility in Ashford, Ala. ETI is one of a limited number of commercial laundry vendors, which service the U.S. commercial nuclear industry. The tests were performed to determine the relative "release" characteristics between standard 65/35 cotton/polyester blend fabrics and OREX™ 65 grams per square meter (gsm) nonwoven, non-treated, polyvinyl alcohol based fabrics. The industry currently uses reusable cotton/polyester blend fabrics in products, such as vests, including ice vests. The "contaminants" used in this test were radioactive surface contaminants typical of that common to nuclear fission fuel cycle facilities. The contaminants used were primarily in solid or particulate form. Some soluble forms were present as well (i.e., Cesium-137, 134). The ETI laundry process is used to (a) decontaminant garments and then (b) filter the contaminants from the process water. These filter deposits were used as the contaminant source for this study. The test patches were highly contaminated, which correlates to several millions dpm (disintegrations per minute). (Most products will never ever get that contaminated in practice.)

Several swatches of 65/35 blend fabric and OREX™ 65 gsm fabric (cut from actual vests) were used. The swatches measured approximately 0.15 $m^2$ each. The fabric swatches were contaminated with the filter deposits. The deposits had a consistency of moist sludge. The sludge was worked into the fabric swatches using moderate hand pressure to replicate field conditions of human contact with surface contamination.

The contaminated fabric swatches were then analyzed on gamma spectroscopy equipment located at the ETI facility. The gamma spectroscopy system consisted of a 5.1 cm (2 inches)×5.1 cm (2 inches) NaI detector mounted in a shielded sample cave. The detector was coupled to a Canberra Industries multi-channel analyzer, configured using Canberra's Genie 2000 software. All samples were analyzed using a counting geometry calibrated for analysis of 1 liter soil samples. Contamination reduction factors were derived from the analysis data, providing accurate relative results between the two types of samples.

Each fabric sample was analyzed both prior to and after washing (decontamination). The decontamination process was completed by performing a normal wash cycle in one of ETI's commercial washing machines. Both types of swatches were washed simultaneously in the same machine in each trial. The machine was a Milnor commercial washing machine available from Pellerin Milnor Corporation (Kenner, La.). Water temperature was 15° C. Following the final spin cycle, the fabric samples were centrifuged at about 200 to 212 g's for about 2-4 minutes, and then dried at a temperature of about 60° C. (140° F.) in a commercial dryer available from Cissell Manufacturing Company (Louisville, Ky.) for about 30 minutes Fabric samples were contaminated with enough radioactive material so that the swatches after washing would have at least a lower level of detectability (LLD) detectable by the above-described detector. From the before and after values, accurate decontamination factors (DF's) were determined.

Fabric samples were tested using the above-described detector and counted for 60 minutes to determine radioactivity concentrations present (i.e., fabric swatches were mounted in the shielded sample cave for 60 minutes). The results are shown in Table 1 below.

TABLE 1

Release Data For 60 Minute Counting Times

| Substrate | Isotope | Before | After | DF |
|---|---|---|---|---|
| Cloth | Mn-54 | 6.10 E+5 | 3.52 E+4 | 17 |
| OREX ™ | Mn-54 | 3.51 E+5 | 5.71 E+2 | 615 |

TABLE 1-continued

| Release Data For 60 Minute Counting Times | | | | |
|---|---|---|---|---|
| Substrate | Isotope | Before | After | DF |
| Cloth | Co-58 | 6.13 E+5 | 3.54 E+2 | 17 |
| OREX ™ | Co-58 | 3.53 E+5 | 5.74 E+2 | 615 |
| Cloth | Co-60 | 1.08 E+6 | 6.54 E+4 | 17 |
| OREX ™ | Co-60 | 5.82 E+5 | 1.62 E+3 | 359 |
| Cloth | Cs-134 | 1.30 E+5 | 7.38 E+3 | 18 |
| OREX ™ | Cs-134 | 8.37 E+4 | <LLD | >36 |

As seen in Table 1, the comparative data demonstrates the following surprising improvement over conventional reusable cotton/polyester blend vests:

(1) Decontamination factors for 65/35 blend fabric are on the order of 17-20. In other words, post-wash activity is about ½0th of pre-wash activity.

(2) Decontamination factors for 65 gsm OREX™ were greater than 600. In other words, at least 99.8% of the radioactivity is removed during the wash.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A vest comprising water-soluble nonwoven fabric material formed from water-soluble polyvinyl alcohol fibers, said vest being shaped and sized so as to fit about a torso of a person, and when fitted about the torso of a person, said vest having (i) a neck opening for a neck of the person and (ii) arm openings for arms of the person, wherein the vest is capable of being washed in an aqueous bath without negatively impacting the structural integrity of the vest.

2. The vest of claim 1, wherein the vest is pre-washed.

3. The vest of claim 1, wherein the vest is capable of being washed in an aqueous bath up to about 20 times without negatively impacting the structural integrity of the vest.

4. The vest of claim 1, wherein the vest consists essentially of water-soluble material.

5. The vest of claim 1, wherein the vest consists of water-soluble material.

6. The vest of claim 1, wherein the vest comprises a closure system.

7. The vest of claim 6, wherein the closure system comprises one or more zippers, drawstrings, snaps, buttons, adhesives, hoop and loop materials, or a combination thereof.

8. The vest of claim 6, wherein the closure system comprises water-soluble material, water-dispersible material, or a combination thereof.

9. The vest of claim 1, wherein the vest comprises two or more nonwoven fabric sheets joined to one another with one or more sheet fastening devices.

10. The vest of claim 9, wherein the one or more sheet fastening devices comprise thread, adhesives, hoop and loop materials, or a combination thereof.

11. The vest of claim 9, wherein the one or more sheet fastening devices comprises water-soluble material, water-dispersible material, or a combination thereof.

12. The vest of claim 9, wherein each nonwoven fabric sheet comprises spunlaced nonwoven fabric formed from polyvinyl alcohol fibers and having a basis weight of about 65 grams per square meter.

13. The vest of claim 1, wherein the vest comprises at least one single ply nonwoven fabric, at least one double ply nonwoven fabric, at least one nonwoven fabric/film laminate, or a combination thereof.

14. The vest of claim 1, wherein the vest comprises one or more pockets.

15. The vest of claim 14, wherein the vest is an ice vest and comprises up to about 6 pockets.

16. The ice vest of claim 15, in combination with one or more pieces of ice or dry ice.

17. The vest of claim 14, wherein the vest is a dosimetry vest and comprises about 5 pockets.

18. The vest of claim 1, wherein the vest comprises pre-shrunk nonwoven fabric having a fabric shrinkage of less than about 5% when exposed to a washing cycle.

19. The vest of claim 1, wherein the vest comprises nonwoven fabric substantially free of lint and static.

20. The vest of claim 1, wherein the vest comprises at least about 70 parts by weight (pbw) of water-soluble material.

21. The vest of claim 1, wherein the vest comprises at least about 90 parts by weight (pbw) of water-soluble material.

22. A vest comprising water-soluble nonwoven fabric material formed from water-soluble fibers, said vest being shaped and sized so as to fit about a torso of a person, and when fitted about the torso of a person, said vest having (i) a neck opening for a neck of the person and (ii) arm openings for arms of the person, wherein the vest is capable of being washed in en aqueous bath without negatively impacting the structural integrity of the vest.

23. The vest of claim 22, wherein the water-soluble fibers comprise water-soluble polyvinyl alcohol fibers.

24. The vest or Claim 22, wherein each water-soluble nonwoven fabric material comprises spunlaced nonwoven fabric formed from polyvinyl alcohol fibers and having a basis weight of about 65 grams per square meter.

25. The vest of claim 22, wherein the vest comprises at least about 70 parts by weight (pbw) of water-soluble material.

26. The vest of claim 22, wherein the vest comprises at least about 90 parts by weight (pbw) of water-soluble material.

27. A vest comprising water-soluble fabric material formed from water-soluble fibers, said vest being shaped and sized so as to fit about a torso of a person, and when fitted about the torso of a person, said vest having (i) a neck opening for a neck of the person and (ii) arm openings for arms of the person wherein the vest is capable of being washed in an aqueous bath without negatively impacting the structural integrity of the vest.

28. The vest of claim 27, wherein the water-soluble fabric material comprises a nonwoven fabric of water-soluble fibers.

29. The vest of claim 28, wherein the water-soluble fibers comprise water-soluble polyvinyl alcohol fibers.

30. The vest of claim 27, wherein each water-soluble fabric material comprises spunlaced nonwoven fabric formed from polyvinyl alcohol fibers and having a basis weight of about 65 grams per square meter.

31. The vest of claim 27, wherein the vest comprises at least about 70 parts by weight (pbw) of water-soluble material.

32. The vest of claim 27, wherein the vest comprises at least about 90 parts by weight (pbw) of water-soluble material.

* * * * *